United States Patent [19]

Roen et al.

[11] Patent Number: 4,769,126

[45] Date of Patent: Sep. 6, 1988

[54] BOTTOM GUSSET BAG PAD ARRANGEMENT FOR LIQUID CONTAINERS

[75] Inventors: Ralph M. Roen; Terry D. Gebhardt, both of Longview, Tex.; Richard C. Dokmo, Barrington, Ill.

[73] Assignee: T. C. Manufacturing Company, Inc., Evanston, Ill.

[21] Appl. No.: 68,062

[22] Filed: Jun. 30, 1987

[51] Int. Cl.[4] ..... B65D 30/20

[52] U.S. Cl. ..... 206/554; 383/7; 383/9; 383/37; 383/38; 383/120

[58] Field of Search ..... 206/554; 383/6, 7, 9, 383/38, 37, 120

[56] References Cited

U.S. PATENT DOCUMENTS

| | | | |
|---|---|---|---|
| 2,444,685 | 7/1948 | Waters . | |
| 3,016,806 | 1/1962 | Schoen et al. . | |
| 3,312,339 | 4/1967 | Million | 206/57 |
| 3,321,354 | 5/1967 | McCutcheon Sloan et al. | 156/499 |
| 3,660,959 | 5/1972 | La Fleur | 383/7 X |
| 4,046,257 | 9/1977 | Lehmacher | 206/554 X |
| 4,181,069 | 1/1980 | Porter . | |
| 4,493,419 | 1/1985 | Prader et al. | 206/554 |
| 4,526,565 | 7/1985 | Hummel et al. | 493/196 |
| 4,557,384 | 12/1985 | Membrino | 206/554 |
| 4,676,378 | 6/1987 | Baxley et al. | 206/554 |
| 4,696,403 | 9/1987 | Hoover | 383/38 X |

FOREIGN PATENT DOCUMENTS

| | | | |
|---|---|---|---|
| 545265 | 8/1957 | Canada | 383/38 |
| 1958690 | 5/1971 | Fed. Rep. of Germany | 206/554 |
| 1073913 | 6/1967 | United Kingdom | 206/554 |

*Primary Examiner*—William Price

*Attorney, Agent, or Firm*—Mann, McWilliams, Zummer & Sweeney

[57] ABSTRACT

A bag pad arrangement, and method of making same from tube stock, for bagging a pair of liquid containers, such as containers for carry out for milk shakes, carbonated beverages, and other types of drinks, that are commonly available at fast food outlets, at the point of sale of such products, for easy and effective carry away by the customer, in which the bags of the bag pad are all the same and are incorporated in the pad in congruent relation, with each bag having a bottom fold that is gusseted for flat bottom shaping when open, front and back panels extending between side end seals that extend normally of the bag bottom that are spot welded together at the center of the bag but spaced from the bottom gusset thereof, and that define rectilinear side edgings forming the upper corners of the respective bags that extend to the bag end seals adjacent to but spaced from the bottom gusset thereof, and aligned handle forming openings formed in the bag front and back panels adjacent the upper end of each bag; as incorporated in the bag pad, the back panel of each bag includes a projecting flange that extends beyond the top edging of the bag front panel which is free of the back panel to form the mouth of each bag. The bag back panel flange includes a score line and the bags of the pad are united in pad form by heat welding the bags together at the top edging of the back panel flange, with a pad mounting hole or holes being formed in the pad bag back panel flanges for mounting of the bag pad to dispense the bags therefrom one at a time starting with the bag exposed at the front of the pad, as needed at the fast food facility to bag the usual liquid beverage containers at the point of sale the same for ready carrying away by the customer.

7 Claims, 5 Drawing Sheets

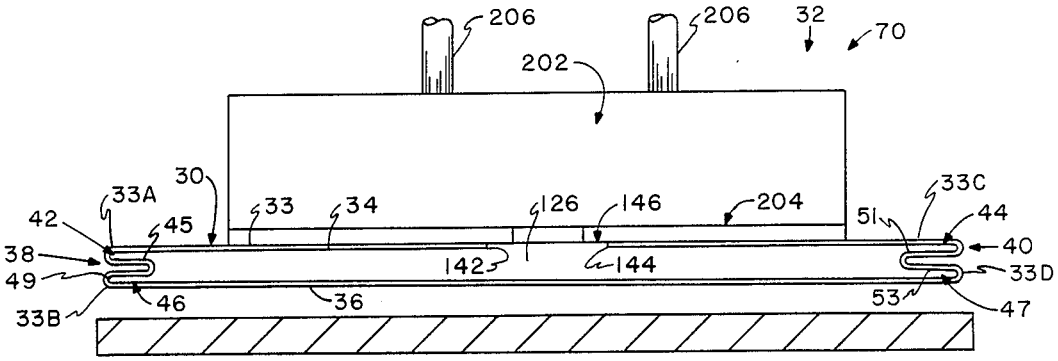
FIG. 2
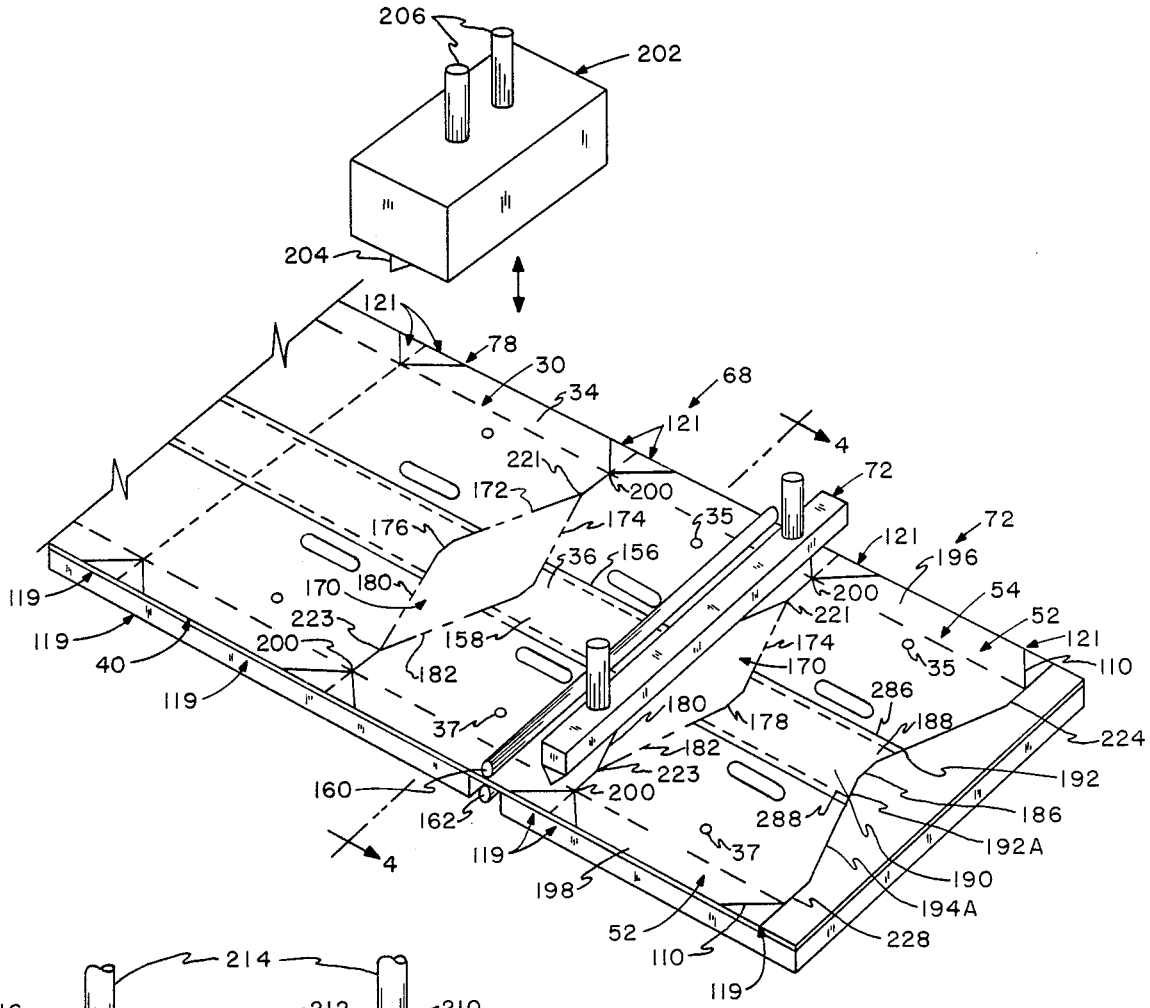
FIG. 3
FIG. 4

BOTTOM GUSSET BAG PAD ARRANGEMENT FOR LIQUID CONTAINERS

The present invention is directed to flat bottom bags formed from plastic film tube stock, and more particularly, to such bags as incorporated in pads for use at the point of sale of beverages, such as milk shakes or carbonated drinks, at customer checkout counter facilities of, for instance, the so-called "fast food" retail outlets, for fast and efficient bagging of such beverage containers for immediate carrying away by the carry out customer.

The incorporation of flexible bags formed from plastic sheeting in pads of identical bag form for manual or automatic bagging is per se well known to the art. See, for instance, Million U.S. Pat. No. 3,312,339, granted Apr. 4, 1967, and Porter U.S. Pat. No. 4,181,069, granted Jan. 1, 1980.

However, the arrangement of the individual bags involved in conventional bag pads generally has not permitted the forming of the bag pads from a single web stock, to provide that when the bags are opened up for filling while yet a part of the pad, they define an open top that receives a beverage container of the type indicated, and when so loaded and separated from the pad, define a flat bottom that is free standing.

The-earlier filed patent application Ser. No. 001,856, filed Jan. 9, 1987 (now U.S. Pat. No. 4,717,262, granted Jan. 5, 1988), of two of us (and assigned to the same assignee as the instant application) discloses a flat bottom plastic film bag of the discrete type that is gusseted for providing a bag bottom, when the bag is open, that includes an outer margin that is in circumambient relation to a flattened out central portion of the bag bottom gusset, whereby when the bag is opened, it is shaped for free standing in such open relation for ease of application of groceries or the like thereto.

The discrete bag of said pending application is formed from a web of tube stock of film thickness proportions in such a manner that the discrete bag involved comprises side panels that are severed across the top of the bag to both form the open end of the bag and to define a curved handle arrangement for both of the bag side panels that is centered relative to the bag length dimension for automatic balancing of the bag when it is filled with groceries and the like. The disclosure of said patent application is hereby incorporated herein by this reference to the extent it is not inconsistent with the disclosure of the instant application.

The principal object of the present invention is to provide a bag pad made up of a predetermined number of identical, congruently stacked, bags adhered together in stacked relation at the bag tops, with the remainder of the bags being free for ready separation from the pad, starting at the front of the pad, for use as needed, at, for instance, the customer checkout counters of fast food facilities for bagging beverage containers, whereby the checkout clerk having a bag pad of the type herein disclosed vertically mounted at his work area, conveniently within his reach, can open the bag of the bag pad facing him, insert one or a pair of liquid beverage containers therein that represent the customer's carry out purchase, separate the bag from the pad, close the bag over the purchase by hand gripping the bag handle apertures formed in the bag front and back panels, and hand the closed bag to the customer for ready carry out of the customer purchased carry out beverage containers.

Another principal object of the invention is to provide a bag pad that is made up of a predetermined number of identical, congruently oriented bags, adhered together at the top of the bag, for ready consecutive separation from the front of the pad, when appropriately mounted adjacent the fast food facility carry out service check out counter, within reach of the clerk checking out a customer's beverage purchase, with the bags of the pad being oriented for ready opening of the bag by the clerk for inserting the usual fast food beverage containers in the bag, after which the bag is separated from the pad and closed over the food containers by the clerk, for handing to the customer for ready carry out purposes.

Another important principal object of the invention is to provide bag pads of the type indicated in which the individual consecutive bags of the pad, as they are reached for removal from the pad, define upper ends that are adhered together at the tops of the respective bags of the pad, and at projections of the bag back panels, but with the bag front panel being free from the bag back panel at its top to define an openable mouth for the bag, and with both the back and front panels at top corners of the bag being shaped rectilinearly between adjacent the adhered portions of the pad bags to adjacent the bag side seals well below the center level of the bag, with each bag across its back panel and above the mouth of the bag including a score line for ready separation of the bag from the pad, and each bag having its front and rear panels spot welded together at the centerline of the bag so as to define separate beverage container receiving compartments when the bag is opened up.

Yet another principal object of the invention is to provide a bag pad which can be stationarily mounted at the fast food facility checkout counter or the like that has beverage carry out service for ready loading, tear off, and handing to the customer of individual bags containing containers of the beverage purchased, in which the loading of each bag of the pad requires a minimum amount of time, and the customer can walk away with a neatly balanced bag containing his beverage purchase, which bag remains closed across the beverage containers that has been bagged by way of the customer grasping the bag through handle apertures provided for that purpose at the top of the bag.

Still another, object of the invention is to provide bag pads that are made up of flat bottom bags adhered together at their tops, with the individual bags being of one piece plastic construction of film thickness proportions, defined by front and rear panels that are joined together at the ends of the bag heat weld fashion, that are spot welded together at the centerline of the bag, and that are joined together at the bottom of the bag by being in one piece relation with a gusset that extends continuously and imperforately across the bottom of the bag, which gusset defines on either side of the bag lower portion bag plies that are respectively heat sealed together, but free of heat sealing the sets of the bag plies to each other, with such heat seals being along diagonal seals or welds that extend from the respective bag ends to adjacent the respective bag bottom edgings defined by the respective sets of bag plies (following the disclosure of said above identified pending patent application), for providing a bag bottom, when the bag is open, that defines a pair of open top compartments having flattenable bottoms, whereby when the bag is opened it is shaped for ease of application of beverage containers thereto.

Yet another further principal object of the invention is to provide a method of making bag pads from plastic film web stock that is flattened and has formed along each of its side edgings an in-folded pleat, with the method involving forming the bags from the web stock in such a manner that a pair of the bags to be formed extends transversely of the tube stock web, with the bag bottoms incorporating the web side pleats that are gusseted as part of the method for flat bottom action in use (in accordance with the disclosure of said above identified pending application), with the pair of bags indicated being joined together at their top ends for later separation in the practice of the method, after the pairs of bags in question that have been formed from the tube stock have been separated therefrom and stacked, to provide bag pads in accordance with the invention.

Still another principal object of the invention is to include, in such method, steps that result in the individual bags of each pad defining a front panel having a free upper edging that defines the openable mouth bag, and a back panel that extends outwardly of the bag mouth (as defined by the front panel edging), and which as part of the formation of the bags is in one piece relation with the back panel of the other bag that is paired with the bag in question, and with the front and back panels of the respective bags being spot welded together at the centerline of the respective bags, so that when the indicated pair of attached bags have been formed and both separated from the tube stock web, and stacked in accordance with the invention, the resulting bag pads may be both formed and separated from the stack of connected bags, as well as both the resulting pads being heat formed with one or more mounting apertures for pin mounting or securement of the bag pads adjacent the working position of checkout clerks of fast food facilities, for easy opening of the exposed bag of the pad being used and the shaping of the bag to define a pair of open top beverage container receiving compartments, handy loading of beverage containers in the bag by the checkout clerk, ready separation of the loaded bag from the bag pad, and closing of the bag about the beverage containers in the bag, by the checkout clerk, in a neatly balanced manner, for ready handing to the customer for facilitating carry out of the beverage containers from the fast food facility involved.

In accordance with the invention, a pad of flat bottom bags is formed from flexible plastic material of film thickness dimensions, such as polyethylene or polypropylene sheeting or tubing, in which the bags of the pad are identical and are in flattened congruently oriented relation, with each bag of the pad including side end seals at either end of and extending longitudinally of the ends of the respective bags, a bottom infold extending between the bag side ends and gusseted for flat bottom shaping when the bag is open, a front panel extending between the bag side ends and lengthwise of the bottom fold thereof, and including a free top edging forming the mouth of the bag, a back panel extending between the bag side ends and lengthwise of the bottom fold thereof, which back panel includes a back panel flange projecting a predetermined distance outwardly of the bag mouth to define an edging paralleling the bag bottom fold; the bags of each pad have their respective front and back panels spot welded at the longitudinal centerline of the bag, adjacent but spaced from the bottom fold thereof, so that each bag defines a pair of twin beverage container receiving compartments when the bag is opened up, with the bags of the pad being heat sealed together in said flattened congruently oriented relation, only at and along the back panel flange edgings of the bags of the stack except for the indicated spot weld; the bag pad of the invention provides for the upper corners of each bag at either side of same being defined by congruent and coplanar, rectilinearly shaped, diagonal edges of the bag front and rear panels that extend from adjacent the respective side end seals of each bag below the middle level of each bag to adjacent the bag back panel flange edging of the respective bags, with such diagonal edgings of the respective bags being congruently oriented in the pad, and with the back panel flanges of the respective bags including a score line paralleling the bottom fold of the respective bags and spaced between the bag mouth and the indicated bag back panel flange edging, with the bags of the pad having a handle forming aperture formed in the front and rear panels of the bag that are congruently oriented throughout the pad, as are the referred to bag score lines, the bag diagonal edges, and the bag back panel flange edgings.

The bag pad also has heat formed in the back panel flanges of same one or more mounting apertures to provide for pin mounting of the pad at a vertical wall or horizontal surfacing adjacent to the checkout clerk of the fast food facility involved for ready bagging of the fast food beverage container (that the clerk is to process for the usual carry out food purposes), within the beverage containers involved being lodged in the twin open top compartments defined by the bag when opened, the tear off from the pad of the bag containing the customer's purchase, the closing, over the beverage containers, of the bag front and rear panels by way of the hand hold apertures formed in the now separated bag and grasped by the checkout clerk, and the handing of same to the customer for ready carry out in a balanced manner of the now bagged beverage container purchase of the customer, as by the customer hand grasping together the bag front and rear panels using the indicated hand hold apertures.

The bag pads of the invention are made by the practice of the method of the invention, and from a web of flattened and folded plastic film stock (of the indicated film thickness proportions) that is formed to define a band having of opposed (upper and lower) web stock side walls or panels integrally joined by a pair of web stock opposite side edgings that are spaced apart transversely of the web stock (which may be in the form of tube stock), with the web stock side edgings each being formed to define a continuous in-fold pleat integrally connecting the web stock side walls or panels together at the web stock side edgings, with the web stock being moved essentially horizontal and rectilinearly along a processing way (that includes suitable support for the web stock), with the web stock side walls being essentially horizontally disposed, one above the other, in the processing of the web stock, and with the web stock indicated side edging pleats each forming first and second in-fold web stock plies along and within the respective web stock side edgings. The method involved is concerned with passing (with intermittant motion) the web stock longitudinally thereof along its processing way in flattened relation and essentially horizontally disposed with one side wall or panel of same facing upwardly and the other side wall or panel of same facing downwardly, heat sealing together at and along each of the web stock edgings the first and second in-fold plies, and along pairs of spaced pairs of diagonal heat seals that, for each pair of heat seals, diverge in the direction of the respective web stock edgings and that, for each web stock edging, define a series of adjacent bottom end corners locating the sites of pairs of top connected bags to be formed from the web stock along each web stock side edging transversely thereof. Further processing provided by the method, where tube stock is employed as the web stock, involves removal of a continuous central strip of the tube stock upwardly facing side wall or panel that is centered along the longitudinal center line of the tube stock to expose the other side wall or panel of the tube stock and form the indicated upper side wall or panel of the tube stock to define opposed center located edgings; this step is not needed where the web stock is sheeting folded along the sides of same to define the aforementioned web stock side walls or panels, in-fold pleats and in-fold plies. For both types of web stock, further processing in accordance with the method is concerned with forming a pair of spaced apart parallel score lines in the exposed portion of the web stock under side wall or panel; the method calls for cutting out from the web stock upper and lower panels, and at each bag site now defined on the tube stock, and the location of the upper end of the bag to be there formed, bag hand hold apertures, then forming along and in centered relation to the web stock longitudinal center line of the tube stock, across the exposed portion of the web stock under side wall and the web stock center located edgings, and in centered relation with each pair of said bag bottom end corners that are aligned transversely of the web stock, consecutive cutouts of equal size for defining the bag congruently oriented and rectilinear front and back panel top edging and the bag back panel flange of consecutive sets of the bag transversely extending front and back panels to be formed on either side of the tube stock longitudinal center line, and spot welding the bag front and rear panels together at the centerline of same at each bag site.

The method of the invention further involves the consecutively heat sealing and cutout forming of the web stock transversely of same in centered alignment with the consecutive cutouts and the pair of bag bottom corners that are aligned therewith, the side or end seals of the respective bags of the pair of bags being formed, to consecutively separate each pair of joined bags being formed from the web stock, after which the top connected bag pairs resulting are stacked in congruent relation to form a stack of such bag pairs of a predetermined number per stack, and thereafter the resulting stack is heat seal treated to simultaneously connect the stacked bag pairs through the congruently oriented back panels of the stack and divide the stacked bags into separate bag pads to form in pair form the bag pads contemplated by the invention; also formed at the time the bag pads are separated are one or more mounting apertures that are die cut or punched formed through the stacked bag back panels to provide for pin mounting of the individual pads, in use, adjacent the fast food checkout clerk's working area, for use in the manner that has already been indicated.

Other objects, uses, and advantages will be obvious or become apparent from a consideration of the following detailed description and the application drawings, in which like reference numerals indicate like parts throughout the several views.

In the drawings:

FIG. 1 is a diagrammatic and schematic perspective view of the Applicants' overall method and the bag pads resulting from the practice of this invention, showing the various stations involved for processing the web stock into the bag pads shown in this Figure, with a portion of the web stock at the lower left hand side of FIG. 1 indicating in broken lines the shaping that the individual bags will have transversely of the web stock as the processing of the web stock proceeds in accordance with the invention, and with the web stock being processed being shown in the form of tube stock;

FIG. 2 is a diagrammatic vertical sectional view taken substantially along line 2—2 of FIG. 1 showing in block diagram form the bag top shaping tool involved in elevation, with the tube stock being shown displaced from its supporting bench for clarifying the transverse cross-sectional configuration of the tube stock preferred for the practice of the present invention;

FIG. 3 is a diagrammatic fragmental perspective view of the tube stock pull-push station and bag pair cutoff station that are illustrated in the upper portion of FIG. 1;

FIG. 4 is an elevational view of the bag pair cutoff tool shown in FIG. 3, shown in elevation for clarifying its nature, with this view being substantially along line 4—4 of FIG. 3;

Figure 1:
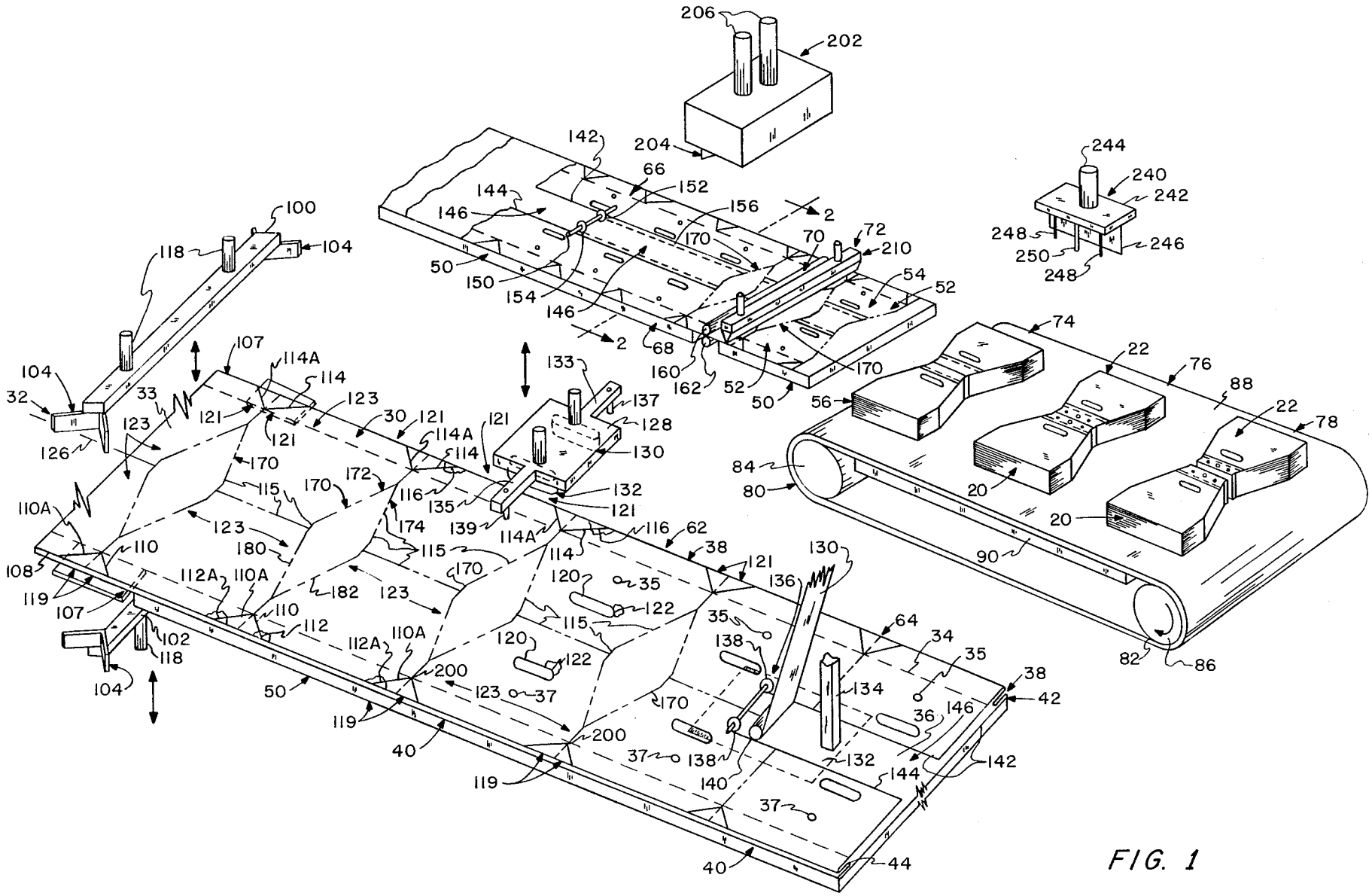

However, it is to be distinctly understood that the specific drawing illustrations provided are supplied primarily to comply with the requirements of the Patent Laws, and that the invention is susceptible of other embodiments or modifications that will be readily apparent to those skilled in the art, and which are intended to be covered by the appended claims.

GENERAL DESCRIPTION

The bag pad, the bags making up same, and the method of the present invention, contemplate the formation of plastic so-called "flat bottom" bags that have a bottom gusset of special design configuration, which are formed from plastic film web stock of a selected thickness and material in accordance with the present state of the art in connection with the manufacture of plastic bags. An important feature of the present invention is that the bag pads and bags making up same hereindisclosed are formed from a web of bag stock formed from polyethylene, polypropolyne, or their equivalents, having a thickness range of from about 0.3 mils to about 1.6 mils, for example.

While the size of the individual bags making up a bag pad in accordance with the present invention is the same for all bags in the pad, the bag size selected to form bag pads in accordance with the invention may vary in accordance with the particular usage for which the bags of the bag pad are intended.

As to the web stock to be employed, the invention contemplates that the basic web stock employed to practice the invention may be tube stock formed, for instance, as part of the overall method or process of producing the bag pads, or the tube stock may be preformed, flattened, and rolled up for processing as contemplated by the present invention.

A key feature of the present invention is that the tube stock in its flattened relation has its side edges infolded to define opposed pleats, similar to the tube stock disclosed in said application Ser. No. 001,856. Tube stock of the type indicated is moved, in accordance with the invention, longitudinally of same, in substantially horizontal relation, and in the indicated flattened relation, with pairs of bags that are to ultimately be incorporated in the bag pads contemplated by the invention being formed crosswise or transversely of the tubular stock so as to be joined at their tops, and at the tops of their back panels with the connection in question lying approximately along the longitudinal center line of the tube stock with the orientation the bag pairs have as they are to be formed from the tube stock. The bottom of each such bag as formed lies at the respective side edges of the tube stock, and thus includess the respective tube stock side edge pleats, which in accordance with the present invention are gusseted in the manner disclosed in said pending application Ser. No. 001,856. Further processing involved includes forming of handle openings through both the upper and lower tube stock panels to be located at the tops of the bags, spot seal welding of the tube stock upper and lower panels together at the longitudinal centerline of the sites of the respective pairs of bags to be formed from the tube stock, removal of a center strip of the tube stock top panel along the longitudinal center line of the tube stock to expose the tube stock back or under panel, formation of a score line for each bag of each bag pair across the under panel of the tube stack (which is to form the back panel of each of the bags in question), the formation of the basic bag top shape for each bag pair at and crosswise of, the longitudinal center line of the tube stock, and a cut off from the tube stock of each bag pair that is formed from the tube stock.

For the purpose of consecutively forming from the tube stock the indicated pair of transversely extending bag pairs, the tube stock may be moved longitudinally of same through a suitable processing way, made up of suitable support tables or benches, conveyor belts or the like, or a suitable ccmbination of same, with the tube stock being moved intermittently in any suitable manner between processing stations, or the processing stations being suitably arranged and located in accordance with state of the art practices to permit continuous web movement through those stations where the processing involved can be performed with continuous movement of the web therethrough, and intermittant movement of the web through those stations requiring a full halt of the web thereat to effect the required processing (such as heat sealing or cutoff).

As already indicated, the web stock processed may also be plastic sheeting of suitable proportions and passed along the processing way folded to provide the web configuration of FIG. 2. The web stock illustrated is of the tube stock type to simplify the drawings insofar as the bag pad forming method is concerned.

The invention further contemplates that as the pair of bags are consecutively formed from the tube stock, they are stacked congruently to a predetermined number of bags that are to be included in the stack, which number may vary from run to run of the bag pads being made in accordance with the invention, depending on the use to which particular bag pads are to be put. One way of so proceeding, in accordance with the method, is disclosed and involves forming such stack of bag pairs on one end of a belt conveyor, at a stacking station there located, with the belt conveyor having its upper run suitably supported against gravity; the stack of the bag pairs then may be moved by the conveyor to a dual bag pad forming and pad separating station at which a suitable heat welding tool simultaneously heat welds the bag pairs of the stack together at the back panel of the individual bags, and also severs at the same location the stacked bag pairs into separate bag pads. Also formed at the same time adjacent the location of the heat weld that secures the bags of each pad together are one or more mounting apertures that extend through the respective pads for mounting the individual bag pads for use.

The thus completed bag pads then are moved by the conveyor to a pick up and packaging station for convenience of further handing and packaging, if desired of the individual bag pads.

The bag pads of the present invention in addition to the individual bags involved having the bottom gusset of said application Ser. No. 001,856, serve special utility at the food carry out customer checkout counter of fast food facilities, such as those that offer beverages to go with cooked chicken, hamburgers or the like, which beverages are suitably contained in the usual rounded and sealed or semi-sealed, plastic containers (of which there are a number of sizes in use to provide, for instance, small, medium and large portions), for customer carry out purposes.

In the illustrated embodiments of the invention, the individual bags of the bag pads are proportioned and arranged to accept a pair of sealed beverage containers that are commonly used for customer carry out service.

In any event, the invention contemplates that as to the individual bag pads formed pursuant to the practice of the invention, the individual bags will each be of the flat bottom type and are free of each other except at what is to be their extreme upper ends. The bag pad is to be hung vertically adjacent the fast food customer checkout station that is to be manned by the fast food facility employee in question, with the bag pad located to be well within the reach of the employee who is to function to bag the beverage containers the customer is "carrying out", and perhaps also collect the money for the customer's carry out purchase.

As will be clear, the idea is that the bag pad is disposed in a stationary position so that the outer or top end of the bag stack involved has the top or outwardly facing bag of the stack free of being covered by the other (consecutively following) bags of the stack, and thus is positioned to receive the beverage container or containers (in pairs) that have been sold. Each bag of each pad each includes, in addition to its gusseted bottom fold, a front panel that is open at its top to define the mouth of the bag, a back panel including a flange extending outwardly of the bag mouth, and that at its outer end is adhered to the other bags (of the pad) through the heat welding operation mentioned; the pad bags also include handle forming openings formed in congruent relation in and through both the bag front and back panels, and a score line that extends crosswise of the bag above the mouth of the bag (this also being in congruent relation throughout the bags of the pad). The bag pad of the invention is arranged to provide for the upper corners of the individual bags on either side of the handle forming openings of same, to be defined by coplanar, rectilinearly shaped, diagonal edges or edgings of the bag front and rear panels that extend from adjacent the respective side end seals of each bag below the middle level of each bag to adjacent the bag back panel flange edging (of the respective bags), with such diagonal edgings being congruently oriented throughout the pad; the front and rear panels of the individual bags are heat spot welded or sealed together at the longitudinal centerline of the bag, adjacent but spaced from the bag bottom fold to define a pair of twin beverage container receiving compartments when the bag is opened up.

With this arrangement for each bag, the clerk bagging the "carry out" food can quickly open the bag to receive one or a pair of beverage containers that are to be "carried out", as by inserting one of such containers into the bag in one of the compartments defined by the bag or, if two such containers are to be "carried out", as by inserting one of such containers in each compartment defined by the freshly opened bag, tearing the bag off the pad, closing the bag upper ends over the drink containers (which effects a centering of the containers within the bag), and handing the bag as thus closed to the carry out customer, who, by instinct (and some verbal instruction, if needed), grasps the bag through the bag front and rear panel handle apertures and walks away with the bagged containers, with the bag involved remaining closed about its contents and its contents centered therein as long as the customer continues to carry the bag in that manner. Further, when the bag is placed on a flat supporting surface, the gusseting of the bag along the in-fold line at its bottom assumes flat bottom shaping, with the bag resting on the support with its gusset midportion flattened and its front and rear panel lower edgings (that are in circumambient relation about the gusset midportion when the bag bottom is resting on a flat supporting surface) cooperating to support the bag in upright relation (as per said pending application). The bag may open up when the customer releases the handle forming apertures, but the lower portions of the bag front and rear panels remain shaped for self bracing relationships for holding the bag upright with its beverage container load, until the containers involved have been removed. When the bag has been unloaded, the bag may be returned to its flattened relation for storage and reuse if so desired. However, the the cost of making the bag is so low that prompt disposal of the bag itself presents no economic problem.

THE METHOD OF MAKING THE INVENTION BAG PADS

Figure 7:
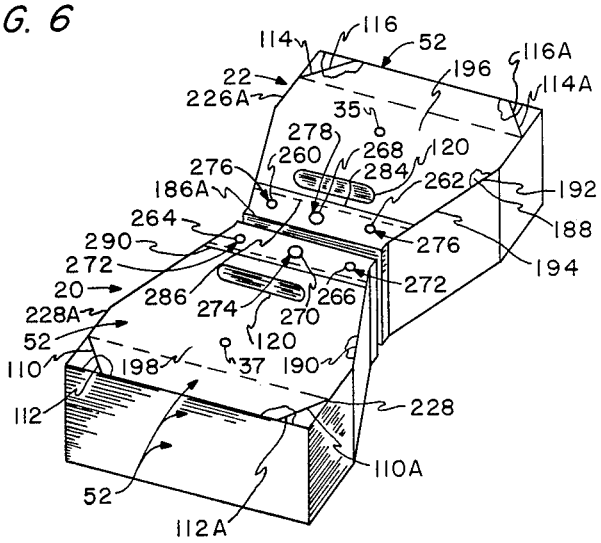
FIG. 7 is an enlarged perspective view of the severed and completed bag pads shown at the bag pickup station of FIGS. 1 and 5.
Figure 13:
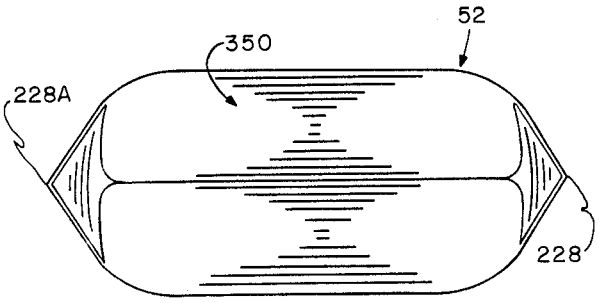
FIG. 13 is a bottom plan view of the bag and its beverage container load of FIG. 13.
Figure 12:
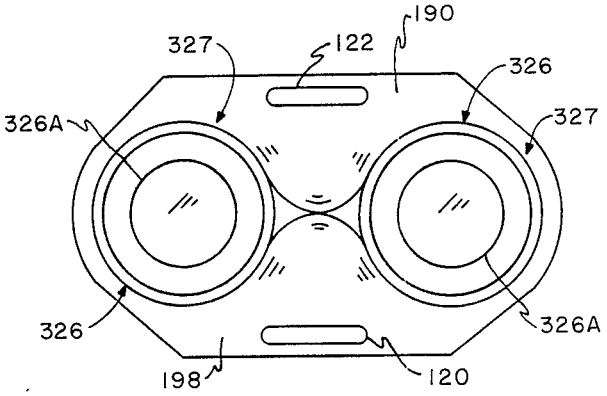
FIG. 12 is a top plan view of the bag of FIG. 1, with its top opened up and showing a pair of beverage containers applied within same.
Figure 14:
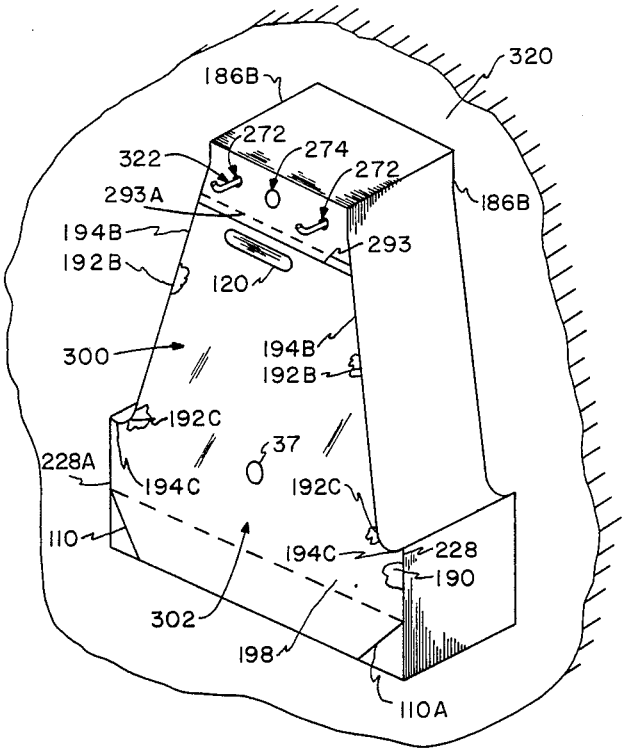
FIG. 14 is similar to that of FIG. 8, but illustrates a modified embodiment of the bag pad involved.
Figure 15:
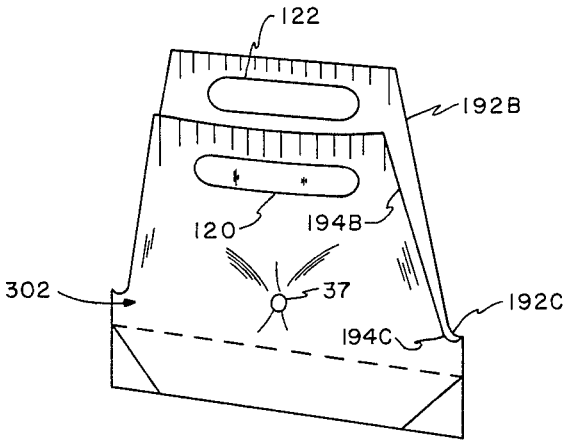
FIG. 15 is a view similar to that of FIG. 11, but shows the bag arrangement of FIG. 14 opened up at its top end.

The showings of FIGS. 1–5 illustrate the basic bag pad forming method in accordance with the practice of the present invention. In the showing of FIG. 1 the Applicants' basic overall method is diagrammatically and schematically illustrated to form the bag pads 20 and 22 that are shown in FIG. 7, and from tube stock that serves as the web stock being processed. As previously indicated, FIGS. 8–11 indicate how these bag pads of the invention may be employed for bagging sealed beverage containers that are available as "carry outs" at a number of fast food facilities, with the showing of FIGS. 12 and 13 illustrating the upper and lower ends of an individual bag to which has been applied a pair of the beverage containers in question. The showing of FIGS. 14 and 15 illustrates an alternate bag configuration for incorporation in bag pads in accordance with the present invention. The diagrammatic and schematic showings of FIGS. 2–5 illustrate specific features of the method of the present invention and are to some extent illustrated in FIG. 1.

Referring now more specifically to FIG. 1, reference numeral 30 indicates a web in the form of tube stock arranged in accordance with the present invention, which tube stock preferably is formed, for subsequent bag formation, as disclosed in said application Ser. No. 001,856, and moved along its processing way 32 in any suitable manner. The transverse cross-sectional arrangement of the tube stock 30 is better illustrated in the showing of FIG. 2 wherein it will be seen that the tube stock 30 is processed in flattened relation in which it defines a pair of opposed tube stock side walls or panels 34 and 36 having integral side edgings 38 and 40, all extending longitudinally of the tube stock 30. The respective side edgings 38 and 40 define the respective side pleats 42 and 44 that extend longitudinally of the tube stock 30, along either of the respective side edgings 38 and 40 of same. As disclosed in said application Ser. No. 001,856, the respective side edge pleats 42 and 44 are similar in nature, and comprise an inwardly extending folds 46 and 47 of the tube stock wall structure 33, which folds 46 and 47 are disposed between the respective tube stock walls or panels 34 and 36. The fold 46 comprises tube stock plies 45 and 49 that are integrally connected to the respective plies 33A and 33B of tube stock wall structure 33, while fold 47 comprises plies 51 and 53 that are integrally connected to the respective plies 33C and 33D of tube stock wall structure 33. The tube stock wide side wall or panel 34 faces upwardly, while the other side panel or wall 36 faces downwardly in the illustrated embodiment, but it will be apparent that the tube stock 30 may be reversed in being disposed for its movement down processing way 32; however, the essentially horizontal positioning indicated is preferred. As already indicated, the web stock may be in the form of the hereinbefore referred to plastic sheeting (not shown), folded, and proportioned for such folding, as indicated in FIG. 2, to define the web components identified with reference to FIG. 2.

The processing way 32 may be defined by suitable supports in the nature of decking or benches 50, or any other suitable support equipment, as will be immediately apparent to those skilled in the art. As has been indicated, the showing of FIG. 2 is largely diagrammatic to bring out the nature of the web stock to be employed, with the tube stock 30 there illustrated being deliberately shown displaced above its support, and with its wide side portions or panels 34 and 36 separated, whereas in practice they are disposed in close adjacency to each other, with the folds 42 and 44 being flattened in-folded relation therebetween. The edgings 38 and 40 and their side pleats 42 and 44 are maintained through the remainder of the processing steps effected on the web stock employed.

In accordance with the invention, the basic web stock employed is processed to form the individual bags 52; in accordance with the practice of the invention, bags 52 are formed in separate pairs 54 that extend transversely of the web stock, and as separated from the web stock, are joined together at their tops, with their bottoms or lower ends of the respective bags 52 to include, continuously thereacross, sections of the respective side pleats 42 and 44 that are gusseted and cut off in the forming of the respective bag pairs 52.

Figure 5:
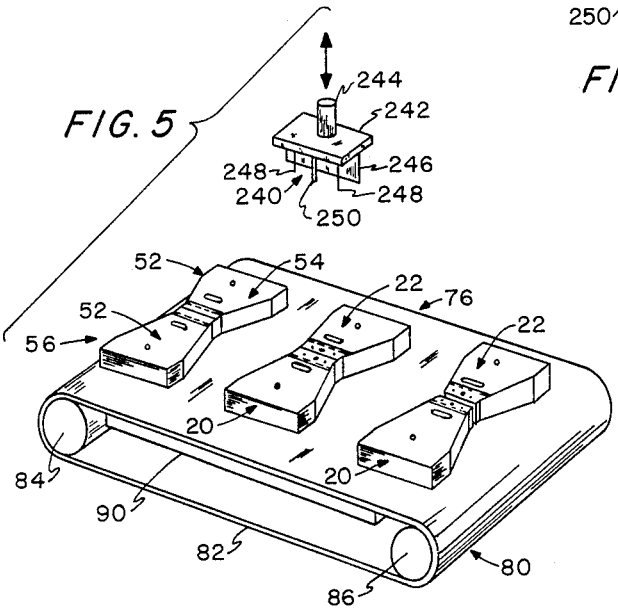
FIG. 5 is a fragmental perspective view separately illustrating the bag pair stacking station, the twin bag pad forming and severing station, and the bag pad pickup station illustrated in FIG. 1, in association with a diagrammatically illustrated belt conveyor and top run support therefor that facilitate the practice of the invention.

As indicated in the right hand portion of FIG. 1 and in FIG. 5, each pair 54 of the individual sets of the connected together bags 52 is manually or otherwise stacked to form a stack 56 of the respective bag pairs 54, which stack 56, in accordance with the invention, is shifted laterally thereof to a supported position in which the individual bags 52 of a pad forming section of a stack 56 are heat welded together while at the same time the stack 56 is subdivided and shaped to define the respective bag pads 20 and 22 as well as the bag pad mounting apertures that are shown in use in FIGS. 8–10 and 14.

For this purpose, the processing way 32, in accordance with the illustrated version of the invention, is arranged to define gusseting diagonal seal forming station 60, the combination web stock through opening forming (bag handle opening forming) and web stock spot (seal) welding station 62, stock top panel center strip removal station 64 (this station is not needed where the web stock is of the indicated plastic sheeting type), score line formation station 66, bag top shaping cutout station 68, web stock pull-push movement providing station 70, and bag pair cut off station 72 that leaves the pair 54 of bags 52 separated from the web stock 30 and resting on the suitable bench or other panel type support 50, for shifting, manually or otherwise, to form the bag pair stack 56, which in the form illustrated, comprises a stacking station 74 on a suitable belt conveyor assembly 80. Assembly 80 is only diagrammatically illustrated as it may be of any suitable type, that shown comprising suitable endless belting 82 trained over suitably journaled end pulleys 84 and 86 (one of which may be driven, as may be dictated by a suitable programmable controller to move the stack 56 to its processing station 76, and thence to its bag pad pick up station 78. The upper run 88 of the belting 80 is shown supported by a suitable bench, table, or the like 90 that is itself suitably supported to hold the belt upper run 86 at a predetermined level against downward pressure during this additional processing of the bag pads 20 and 22.

The tube stock 30 may be gusseted in the manner disclosed in said copending application Ser. No. 001,856. In accordance with the instant disclosure this is effected prior to the station 60, at which station 60 the upper and lower vertically movable head structures 100 and 102 are disposed horizontally above and below the tube stock 30 to form the diagonal gusset seals of the individual bags 52 that are to be in the respective bag pads 20 and 22. The respective head structures 100 and 102 carry adjacent each end of same identical diagonal heat seal forming hot seal heads 104, with the upper and lower sets of heads 104 moving in opposite directions during the diagonal heat seal formation at the station 60, against suitable stationary die plates 106 and 108 that are respectively disposed within the tube stock respective side pleats 42 and 44 to insure separation of the opposed sets of diagonal seals across the side edge plies 33A, 45, and 33B, 49 at the tube stock side edging 38, and plies 33C, 51 and 33D, 53, at the tube stock side edging 40.

Figure 10:
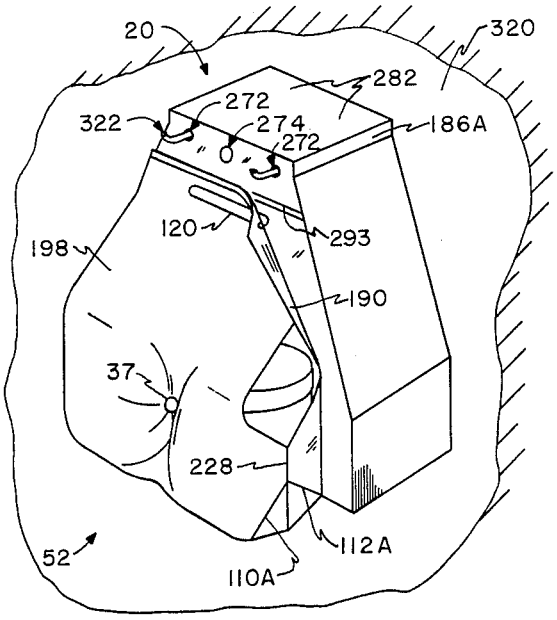
FIG. 10 is similar to the showing of FIGS. 8 and 9, but with the beverage container loaded bag involved being torn off the bag pad.
Figure 11:
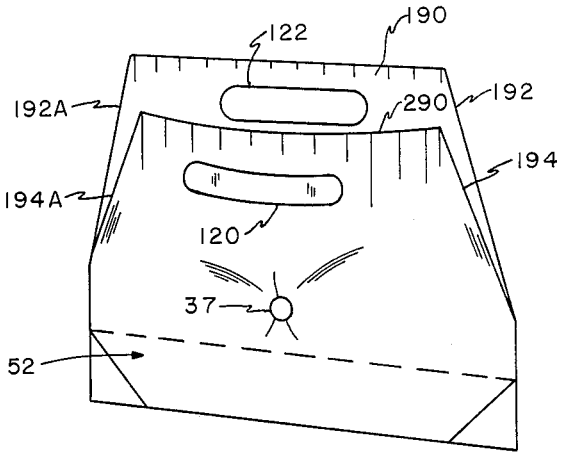
FIG. 11 is a perspective view of a single bag removed from the pad and having its top opened up.

The heads 104 of station 60, as indicated, are all identical in nature, and when compressed against the tube stock side edgings 38 and 40 for this purpose (and against the respective stationary die plates 106 and 108), they form diagonal seals 110, 112 and 110A, 112A that are located to be at one end of the respective bag pairs 54 that are to be formed from the tube stock 30, and the diagonal seals 114, 116, and 114A, 116A that are located at the other end of such bag pairs 54 (see FIGS. 1 and 10). The die plates 106 and 108 are suitably stationarily mounted in the relative positions suggested in FIG. 1, and are preferably Teflon coated and heated on both sides as needed to provide increased speed of operation. One set of the upper and lower heads 104 cooperate with the die plate 106 on one side of the tube stock to form the respective heat seal welds 114, 116, 114A, 116A on the side edging 38 of the tube stock, while the other upper and lower set of heads 104 cooperate with the other side edging 40 of the tube stock and its die plate 108 to form the respective heat welds 110, 112, and 110A, 112A; the heads 104 may be arranged and heated in any suitable state of the art manner for this purpose, and the bench 50 at the location of die plates 106 and 108 is suitably recessed (as at 107) so that the lower or under heads 104 may perform their intended purpose. In this connection, it has been noted that the bag pairs 54 to be formed from the tube stock are indicated in the lower portion of FIG. 1 by phantom lines 115 that are not actually visible on the tube stock 30 prior to the processing step that occurs at bag top shape cut out station 70.

It is also to be noted that the upper and lower head structures 100 and 102 in being shifted to be clamped against the respective die plates 106 and 108 at the appropriate time are moved vertically for this purpose, as by employing suitable air cylinder devices or the like appropriately connected to the respective sets of operating rods 118, to simultaneously effect strokes of the head structures 100 and 102 to bring the heads 104 against the respective die plates 106 and 108 to form the sets of diagonal heat seals 110, 112, 110A, 112A of a lead bag pair 54 (to be formed at the tube stock side edging 40), and the corresponding diagonal heat seals 114, 116, 114A, 116A of the same bag pair 54 (to be formed) at the tube stock side edging 38. Heads 104 thus consecutively form the bag bottom corners 119 and 121 of the to be formed bag pairs 54 at the respective consecutive bag sites 123.

At the combination station 62 several method steps are shown combined (for space savings reasons , the handle forming apertures 120 and 122 are formed in the tube stock 30 on either side of its imaginary longitudinal center line 126 and positioned so as to be centered adjacent the tops of the respective bags 52 to be formed at the respective sites 123, with the through openings 120 and 122 on either side of the tube stock longitudinal center line 126 being congruently aligned and centered with regard to the front and rear panels of the bags 52 of the respective bag pairs 54 that are to be formed (at the individual sites 123) along the length of the tube stock 30, so that the individual completed bags 52 (and the bag pads 20 and 22 comprising same) will have the hand hold openings 120 and 122 that are indicated in FIGS. 8–12.

For this purpose, vertically movable die plate 128 of any suitable type (shown in dashed lines) having on its underside a pair of oblong endless cutter blades 130 and 132 is lowered against the tube stock 30 to cut out, on either side of tube stock 30, the pairs of openings 120, 122, in any conventional manner, to form the hand hold openings illustrated in FIGS. 1,3,5,7–12,14 and 15 for the individual bags. The die plate 128 may, of course, be actuated in any suitable manner, as by a suitable air cylinder device or devices.

Also, at combination station 62, the tube stock side walls or panels 34 and 36 are spot seal welded together to form spot seals 35 and 37 in the tube stock 30 on either side of its imaginary longitudinal centerline 126 and positioned to be centered adjacent and equally spaced from the tube stock respective edge pleats 42 and 44 and disposed at the longitudinal centerline of the respective bags 52 that are to be formed at the respective site 123 (on either side of tube stock centerline 126). For this purpose, die plate 128 as shown is provided with a pair of oppositely extending arms 133 and 135 of equal lengths that have suitably secured to the opposite ends of same heated pins 137 and 139 that are suitably proportioned lengthwise thereof to make the respective spot seals 35 and 37 when die plate 128 is lowered to form the openings 120, 122. Spot seals 35 and 37 are provided to arrange the bags 52 to form the beverage container receiving compartments that are defined by the individual bags 52 when they are opened up for bagging the beverage containers, as described hereinafter.

Assuming that tube stock is employed as the web stock 30 being processed in accordance with the invention, a station 64 is required.

At station 64 the upwardly facing or top panel 34 of the tube stock 30 is processed to form a centrally located strip 130 that is removed from the tube stock to expose the under side, or panel, 36 of same. For this purpose, a relatively thin metallic foot member 132, which may be of the quadrilateral configuration indicated in FIG. 1, is inserted within the tube stock 30 that is passed by same, with the foot member 132 being suitably supported by frame member 134 that is stationarily mounted from overhead and above the processing way 32. Foot member 132 suitably mounts a cutting device 136 comprising a pair of rotating knives 138 which cuts the strip 130 free from tube stock 30 for training about suitably journaled roller 140 and up and away from the tube stock 30 for appropriate disposal. Thus, the station 64 is stationarily mounted to dispose the foot 132 aligned with and centered on the longitudinal center line 126 of the tube stock 30 and disposes the knives 138 equidistantly from the tube stock center line 126 and within the congruently aligned handle forming apertures 120 and 122, whereby a pair of oppositely disposed side edgings 142 and 144 are formed in the tube stock upper panel 34 (creating a rectilinear void 146 (see FIG. 2) in the tube stock top panel 34 that is centered on and aligned with the tube stock longitudinal center line 126.

The station 66 comprises a suitably journaled shaft 150 to which are suitably keyed suitable rotary knives 152 and 154, each of which provides a series of perforations on the now exposed (through void 146) under panel 36 of the tube stock 30 to form the respective score lines 156 and 158 that are incorporate in the respective bag pairs 54 in accordance with the present invention, for purposes of permitting the individual bags 52, after such bag 52 has been loaded as indicated, torn off from its pad 20 or 22 in the manner suggested in FIG. 10.

At the station 68, the top shaping of the individual bag pairs 54 is made in the form of, in the bag pad arrangement of FIGS. 1–12, the elongated six sided cut out that is diagrammatically indicated by reference numeral 170 of FIGS. 1 and 3.

As indicated, configuration 170 is six sided in shape and extends across the void 146, as well as well beyond edgings 142 and 144, in centered alignment with the respective sets of gusseting diagonally oriented heat seals 110, 112, 110A, 112A and 114, 116, 114A, 116A that are disposed at station 68 when the web stock 30 is to be cut out to define such configuration 170. The configuration 170 thus comprises elongate and rectilinear diagonal sides 172 and 174, transverse sides 176 and 178, and elongate and rectilinear diagonal sides 180 and 182 that are respectively opposite the respective diagonal sides 172 and 174.

As indicated in FIG. 3, the formation of consecutive cut outs 170, which is through both the top and bottom panels 34 and 36 of the tube stock 30, in alignment with its longitudinal center line 126, forms the lower panel 36 of the tube stock to define a bag common back panel flange 186, with which the resulting back panels 188 and 190 of the connected together bag pair 54 are integral to have the respective bags 52 connected together at their tops so as to extend crosswise of the web stock 30. This is effected as the transversely aligned sets of the lower corners 119 and 121 of the respective bag sites 123, along the respective side edgings 38 and 40 of the tube stock 30, are presented at station 68, and specifically, when the apexes 200 of gusseting heat welds at the bag site bottom corners 119 and 121 are consecutively presented at station 68.

The individual bags 52 that are connected together form the set of bags 54 that is cut off at station 72 also include the respective front panels 196 and 198 (see FIG. 3), that at the cut off station 72 are heat seal welded to the back panels 188 and 190 of the respective bags 52, as well as across the side edgings 38 and 40 of the tube stock in alignment with the apexes 200 of the respective diagonal heat seal welds 110, 112, 110A, 112A, and 114, 116, 114A, 116A.

The cut outs at stations 62 and 68 may be removed and disposed of in any suitable manner.

The station 70 is illustrated as comprising a pair of pinch rollers 160 and 162 that are suitably journaled between adjacent tube stock supports 50, adjacent bag pair cut off station 72, to grasp the web stock in their "nip", and pull the web stock forward along processing way 32 in the intermittent manner required to process the web stock in accordance with the present invention, "upstream of the station 70, and downstream of the station 70, for processing treatment at the stations 68 and 72. The journaling of rollers 160 and 162 at station 70 preferably is such that the "nip" of these rollers is approximately three inches upstream of the heat seal welding that is performed at station 72.

At the bag pair cut off station 72, a heated cut off device 210 consecutively cuts off from the bag stock 30 the bag pairs 54. Device 210 may comprise, for instance, cross bar 212 having connection rods 214 operably associated with suitable air cylinder apparatus for raising and lowering the device 210; operably connected to the bar 212 is an angle shaped electrically heated plastic sheeting cutter blade 218 which is proportioned to rectilinearly extend between the bottom corners 119, 121 of the bags to be defined at the respective edgings 38 and 40 of the tube stock 30 to fully cut off each bag pair 54 and define the sealed ends 226, 226A and 228 and 228A (see FIGS. 3 and 7), of the respective bags 52; this is thus done across the apexes 200 defined by the respective sets of diagonal gusset forming heat seal welds 110, 112, 110A, 112A and 114, 116, 114A, 116A at the consecutively located bag bottom corners 119 and 121. For this purpose, the cutter blade 218 is formed to define rectilinear shaped cut off edge 230 that is proportioned transversely of the web stock to effect the bag pair cut off that is intended for station 72.

It will thus be seen that in accordance with our method the web stock 30 is to be advanced across its supporting components 50, this being done in any suitable manner, though the rollers 160 and 162 at the push-pull station 70 are illustrative of the type of motivating means that may be employed. The vertically movable head structures 100 and 102, die plate 218 and its cutter blades 130, 132 and spot weld pins 137 and 139, the cutting blade assembly 204, and the bag pair cut off apparatus 210, for the embodiment illustrated, should be moved vertically in synchronism, when forward movement of the tube stock ceases, to perform their respective functions. The operation of the strip removal station 64 and the cutter blade 152 and 154 at the score line forming station 66 perform their functions whenever there is forward movement of the tube stock 30 along its processing way 34. Station 64 is not needed when the web stock 30 is of the sheet type hereinbefore referred to.

With the formation of the individual bag pairs 54 that are joined together at the common bag back panel flange 186 being completed, the individual bag pairs 54 as cut off from the tube stock 30 at station 72 are stacked, as on conveyor assembly 80, to form the stack 56 in which the superposed bag pairs 54 are in the stacked and flattened congruent relationship that is indicated in FIGS. 1 and 5.

Figure 8:
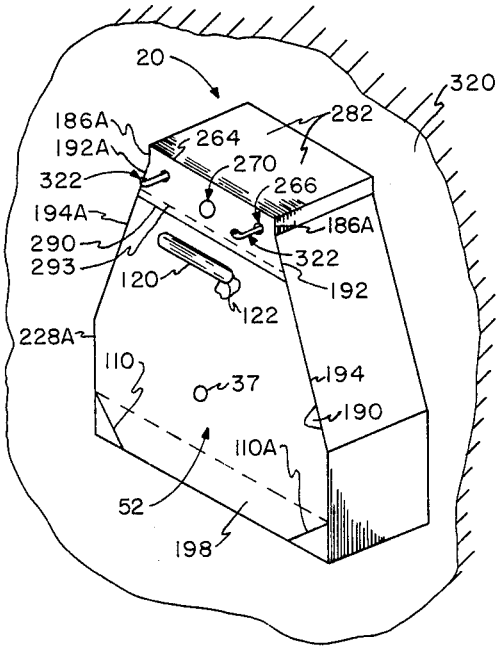
FIG. 8 is a diagrammatic perspective view of the basic bag pad of the present invention hung on a pair of hooks applied to a vertical wall surface and ready for use by a fast food facility cooked food checkout clerk for bagging and giving to the customer a pair of the usual beverage containers that are at fast food carry out facilities.
Figure 9:
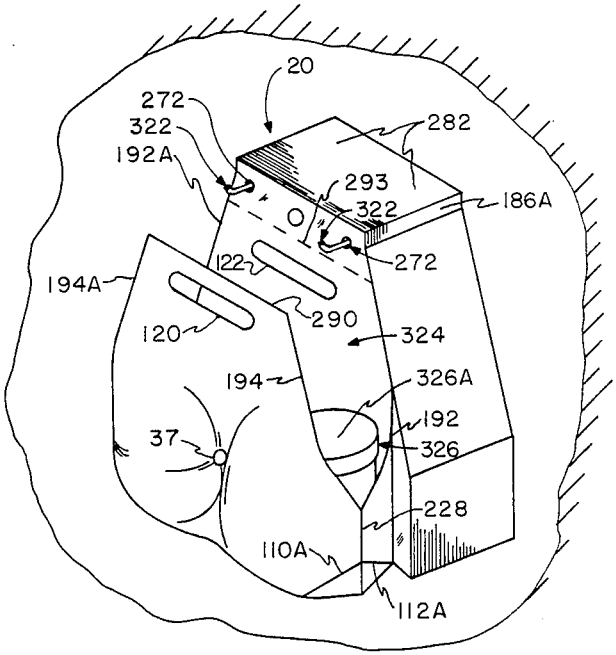
FIG. 9 is a view similar to that of FIG. 8, but shows the exposed bag at the front end of the bag pad involved opened up to receive a beverage container but still attached to the bag pad.

The number of bag pairs 54 to form a stack 56 is optional; assuming that the stack 56 is to include fifty of such pairs 54, when that number has been reached, the conveyor apparatus 80 is actuated to move the stack 56 to the middle position indicated in FIGS. 1 and 5, at which the station 76 is provided for application to the stack 56 the vertically movable heat welding and cutting implement 240 to simultaneously separate the stack 56 into and form respective bag pads 20 and 22 as well as heat weld the bags of each pad together at their respective back panel flanges 186, and also form in the portion of the respective bag back panels that are short of the heat welding together of the bags of each bag pad, as by punching,one or more mounting holes or apertures for mounting the respective bag pads in the manner indicated in FIGS. 8, 9 and 12.

Figure 6:
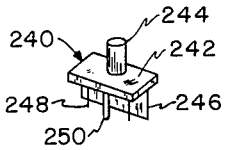
FIG. 6 is a diagrammatic perspective view of the combination heat welding, heat severing, and heat forming tool shown in FIGS. 1 and 5, but illustrating the back side of same.

The welding, cutting and forming tool 240 of FIGS. 5 and 6 comprises a support plate 242 that has fixed to same a suitable rod 244 or the like for moving tool 240 vertically, rod 244 extending to the piston of a suitable compressed air cylinder apparatus or the like, and with rod 244 or plate 242 being suitably guided to perform the heat welding, cutting, and aperture forming functions that are intended. Depending from plate 242 is a centrally located heated combination pad severing and bag welding plate 246 and, disposed on either side of the centrally located plate, a pair of equally spaced punching pins 248 and a centrally located punching pin 250 of somewhat larger diameter. The respective pins 248 and 250 on the front and back side of plate 242 are disposed in coplanar relation, and are equally spaced from the cutting and welding plate 246; the central pins 250 are aligned with the mid portion of plate 246 which in turn is centered on the axis of supported actuating rod 244. The welding plate 246 is heated in any conventional manner to perform the intended cutting and welding operations on the stack 56 that has been shifted to the station 76 for this purpose, with the punching action of pins 248 and 250 on the stock 56 being effected at the same time.

As has been indicated, the stack 56 when completed is made up of stack bag pairs 54 which are physically arranged such that, for each bag pair 54, a single ply portion of the connected together bag back panels 188 and 190 is what the tool 240 is to be appied to, for each stack 56, the single ply in question being in the form of the united bag back panel flanges 186 shown more specifically in FIG. 3.

The stacks 56 are applied to the conveyor apparatus 80 with the positioning that aligns the stack back panel flanges 186 in centered relation with the heated plate 246 of tool 240 when the stack 56 is positioned at station 76, and tool 240 is moved through its indicated operational stroke to perform the functions indicated. This may be done either manually or mechanically, as will be apparent to those skilled in the art.

In any event, when a stack 56 reaches the station 76, the motion of conveyor apparatus 80 (to the right of FIGS. 1 and 5) is ceased, with the stack 56 to be processed by the tool 240 being disposed so that the cut off blade 246 is centered on and extends across the length of the back panel flanges 186 of the stack 56. Tool 240 is then lowered to perform the three forming operations involved, namely to slice or cut the stack 56 in half, or in other words separate the bag pads 20 and 22 from each other, along the center line of the back panel flange 186 of stack 56, and also heat weld together the individual bags 52 of the respective and now severed bag pads 20 and 22 together along the resulting back panel flange segments 186A (see FIG. 7) of the individual bags 52; in addition, the pins 248 and 250 on either side of the tool 240 punch form the respective bag back panels 188, 190 to define a pair of small diameter apertures 260 and 262, and 264, 266, respectively, as well as a relatively large aperture 268 in the back panel 188 and the relatively large aperture 270 in the back panel 190.

The respective apertures formed by the pins 248 and 250 of the tool 240 are formed in all of the bags 52 of the former stack 56, now the respective bag pads 20 and 22, so that the bags 52 of, for instance, bag pad 20, define a pair of relatively narrow through openings 272 and the relatively wide through opening 274, while the bags of the pad 22 define a pair of relatively narrow through openings 276, and a relatively wide through opening 278. For both bag pads 20 and 22, the relatively wide through apertures 274 and 278 are located at the longitudinal center line of the bag pad involved.

This completes the processing of the bag pads 20 and 22, after which the apparatus 80 may be operated to position the respective bag pads 20 and 22 at station 78 for ready pick up and packaging as needed or desired, manually, or automatically.

It will thus be seen that the method of the invention provides two identical bag pads 20 and 22, with each such bag pad comprising the respective individual bags 52 in stacked relation and equal in number, as well as being adhered to each other along the back panel flange extensions 186A.

As to the bags 52 of bag pad 22, the bags 52 are bottom gusseted and comprise back panel 188 and front panel 196. The front panel 196 is open at the upper end of the bag since its top edging 284 is defined by a segment of edging 142 that has been formed by the practice of the invention on tube stock 30; the front panel 196 also includes handle forming opening 120. The back panel 188 includes tear line 286 that is a portion of the score line 156 of the tube stock 30, with the through openings 260, 262, and 268 being defined by the back panel 188 above the tear line 284, and the back panel 188 also having handle forming opening 120 that is aligned with the corresponding opening 120 of the bag front panels 196 throughout the pad 22. The rectilinear diagonal bag top edgings 192 and 194 of the respective front and back panels of the bags 52 of pad 22 intersect the side or end seals 226 and 226A, respectively, of the individual bags 52 (of pad 22) adjacent but spaced above the bag bottom gusset, and of course, individual bags 52 of the bag pad 22 are adhered together in stacked relation at their respective panel flange segments 186A along the edgings 280 thereof.

As to the bag pad 20, the individual bags 52 of same are similarly constituted; thus, the individual bags 52 of pad 20 comprise back panel 190 and front panel 198 that are heat sealed together at the respective bag end seals 228 and 228A. The front panel 198 of the respective bags 52 (of pad 20) also includes the handle forming opening 120 adjacent its edging 290 (that correspond to edging 284 of the bags 52 of pad 22), and in a centrally located position at the top of the bag. The edging 290 referred to is defined by a portion of the edging 144 of the tube stock 30, and thus is free of the back panel of the bag 52 involved, and thus defines the mouth of the bag 52. The back panel 190 of the respective bags 52 (of pad 20) defines tear line 293 that is a portion of the score line 158 formed in the tube stock 30, with the apertures 264, 266 and 270 being formed in the bag back panels 190 (of pad 20) being spaced from the tear line 293 thereof in a direction toward the bag panel flange 186A at which the bags 52 of pad 20 are adhered together. The rectilinear diagonal top corner edgings 192 and 194, and 192A and 194A, of the respective front and back panels 190, 198 of the individual bags 52 (of pad 20) directly intersect the respective bag side end seals 228 and 228A adjacent to but spaced from the bag bottom gusset, and at approximately the one third height level of the bag, on either side of same, above the bottom of the bag (in the illustrated embodiments). As indicated, the bags 52 of bag pad 20 are adhered together in stacked relation at their respective panel flange segments 186A along the edgings 282 thereof.

Referring now to the showing of FIGS. 13 and 14, the bag pad 300 is made in the same manner as bag pads 20 and 22, and the individual bags 302 thereof have the same general shaping as the bags 52 (as indicated by corresponding reference numerals), except that the top corner edgings of the individual bags 302 that make up the bag pad 300 have elongate rectilinear portions 192B and 194B on either side of the individual bag back and front panels respectively, of the individual bags 302 involved, that extend well below the mid level of the bag with the remainder of the respective back panels of bags 302 above the bag tear line level defined by the tear lines 293A being oriented to extend longitudinally of the bag pad 300, to define flange extensions 186B, and thus depthwise of each individual bag 302, and transversely of the tube stock from which the bag pad 300 is formed, that are separated from similar back panel extensions 186B of similar bags 302 of the bag pad 300 that is to be separated from a similar bag pad 300 in the practice of the invention. In addition, the individual top corner edgings 192B and 194B below the middle level of the bag merge into the respective curvilinear portions 192C and 194C for the individual bag front and back panels respectively, on either side of same, which curvilinear portions 192C and 194C on either side of the individual bags 302 inhibit tearing at the bag side edges 228 and 228A.

As indicated, the bag pads 300 and their individual bags 302 are made practicing the method heretofore described with respect to the making of bag pads 20 and 22, the steps of which will be the same except that the cut out configuration 170 that is formed at station 68 will be configured to provide the top corner edging portions 192B, 194B, and 192C, 194C in the respective bag pads 300 and their bags 302.

The bag pads 300 are employed in the same manner as bag pads 20 and 22 for bagging one or several beverage containers (not shown) for carry out purposes.

THE INVENTION BAG PADS AND MANNER OF USING SAME

FIGS. 8–11 indicate one way in which the bag pads 20 and 22 may be employed with facility, as at the work station of a fast food checkout clerk who is to also bag the customer's purchased beverage containers.

For this purpose, one of the bag pads 20 or 22, for instance, the bag pad 20, is mounted adjacent such checkout station, as, for instance, on a vertical wall 320 (see FIG. 8) that is equipped with a pair of holding screws 322 that have their respective threaded ends applied to the wall surface 320 in spaced apart horizontally disposed relation in accordance with the spacing of the through apertures 264 and 266 defined by the bag pad 20. This permits the bag pad 20 to be hung from the set of screw members 322. As the screw members 322 are to be aligned in a more or less horizontal plane, the bag 20 hangs vertically from the screw members 332 adjacent the wall 320, and is assumed to be within easy reach of the station in which the food purchase bagging is to take place.

In the showing of FIG. 8, the bag pad 20 is illustrated mounted ready for use, with the first bag 52 exposed for such use, and in flattened relation, as are all the bags 52 making up the bag pad 20. As has been previously indicated, the respective bags 52 are separate from each other except for the heat weld connecting same at the back panel flange segments 186A of each bag in the bag pad 20.

When a carry out customer approaches the checkout station with one or more beverage containers 326 (such containers 326 each being of a common plastic type having a lid 326A across its top for carryout sealing purposes and being of the eight, twelve, sixteen, thirty-two or sixty-four, ounce size, depending on the quantity of beverage selected by the purchaser), the clerk who is to bag one or more of such containers opens the first or exposed bag 52 of the bag pad 20 and inserts into the then open mouth 324 of the bag in question, the container 326, which is shown inserted in the showing of FIG. 9, this being done while the exposed bag 52 remains still attached to the bag pad. Note that the bag bottom gusset as defined by its diagonal gusset forming welds 110, 112, 110A, 112A, and 114, 116, 114A, 116A, results in the bottom 350 of the bag flattening out (see FIG. 13) as the container descends to the bottom of the bag. In this connection, the bags 52 employed for bagging purposes in accordance with the invention each have the aforedisclosed centrally located spot weld 35 or 37, with the result that when the individual bags 52 are opened up for bagging the containers 326, the bags 52 define a pair of side-by-side compartments 327 (see FIG. 12), each one of which will receive a container 326 (bearing, as indicated, its sealing lid or cap 326A). Bags 52 are arranged to accept one or several of the containers 326 in the container sizes conventionally offered by fast food facilities for containing beverages. Of course, for this purpose, the check out station at which the containers 326 are bagged may be provided with a number of the bag pads 20 applied to vertical wall 320 within easy reach of the bagging clerk, the bags of which are proportioned to receive one or several containers of the various sizes used by fast food facilities. However, the bags 52 are sufficiently flexible to accept any of the standard size containers, used for this purpose, in either single or twin pack form.

The twin pack bagging relation is preferred and is what is illustrated, with one container 326 being applied to each compartment 327 defined by a bag 52 being loaded.

After the first bag 52 is loaded, it is torn from the bag pad 20, as indicated by the showing of FIG. 10, after which the bag back and front panels 160, 198, respectively, may be closed over the now bagged containers by the clerk grasping the handle forming openings 120 and 122 of the bag 52 and handing the bag to the customer who, by intuition or instruction (if needed) grasps the bag 52 (in question) in the same manner, and thus is able to walk away from the box bagging station with a neatly balanced bag 52 that remains closed about its contents by way of the customer grasping the bag through the handle forming apertures 120, 122 of the bag front and rear panels. The torn off fragment 190A of the freed bag back panel 190 remains adhered to the bag pad 20 at its flange fragment 186A.

As indicated in the showings of FIGS. 9 and 10, the bag upper corners or edges defined by the rectilinear edgings 192, 192A, 194, 194A, tend to center the bagged container load within the container when the bag front and rear panel handle forming openings 120 and 122 are grasped together, with a portion of the sides of the bagged containers, at the sides of the bag being exposed as a result of this centering action. This is considered an important distinguishing feature of the bag 52 of this invention. Further, the larger containers 326 improve the centering action involved due to the convexly rounded shaping of the sides of the containers 326 that are exposed at the sides of the bag (see FIGS. 9 and 10).

The bag pad 20 (as well as the bag pad 22) may be employed for bagging the fast food facility carry out customer's beverage purchase in essentially the same manner as shown in FIGS. 8, 9 and 10. When the customer reaches the bagging station, the bagging clerk takes the beverage container in one hand, grasps the front panel top edging 290 or the hand opening 120 (of the exposed bag 52), and opens the mouth of same, after which he can insert into the bag a beverage container in each compartment 327 defined by same. The clerk then tears off the bag 52 in question along the tear line 293, closes the bag front and rear panels over the bag box load, as by grasping the bag hand hold openings 120 and 122, and hands the box containing bag 282 to the customer who grasps the bag in the same manner (for one of the reasons indicated) and therefore walks away with a neatly balanced bag that remains closed about its contents by way of the customer maintaining his grasp of the bag through the front and rear bag panel handle forming apertures.

The bag pad 300 is obviously employed in essentially the same manner as bag pads 20 and 22, when applied as indicated in FIGS. 8–10.

It will be apparent that the apparatus acting at each station hereindisclosed, as well as the intermittentant longitudinally feeding of the tube stock, and that provided by conveyor apparatus 180 (or its equivalent) may be controlled automatically using conventional programmable controller apparatus or the like, as needed to have the processing step coordination needed to process the hereindisclosed invention.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In a pad of flat bottom bags formed from flexible plastic material of film thickness dimensions, in which the bags thereof are in flattened congruent relation, with each bag including side end seals at either end of same and extending longitudinally of the ends of the respective bags, a bottom fold extending between the bag side ends and gusseted for flat bottom shaping when the bag is open, a front panel extending between the bag side ends and lengthwise of the bottom fold thereof and including a free top edging forming the mouth of the bag, a back panel that extends between the bag side ends and lengthwise of the bottom fold thereof and including a back panel flange projecting a predetermined distance outwardly of the bag mouth to define an edging paralleling the bag bottom fold, with said bags being heat sealed together in said flattened congruent relation along the back panel flange edging, the improvement wherein:

the upper corners of each bag at either side of same are defined by diagonal edges of the bag front and back panels that extend from adjacent said back panel flange edging of the respective bags to adjacent the respective side end seals of each bag, with said back panel flanges of the respective bags including a score line paralleling the bag bottom fold and spaced between the bag mouth and the bag back panel flange edging, said diagonal edges of the bags extending below the mid level of the respective bags, and said diagonal edges of the bags and said score lines being in congruent relation in the pad.

2. The improvement set forth in claim 1 wherein:

at least one aperture extends through said pad between said congruently oriented score lines and the bag pad bonding at the bag back panel flange edgings.

3. The improvement set forth in claim 2 wherein:

said aperture is centered along the bag pad back panel flanges, and including a pair of supplemental apertures extending through said pad back panel flanges at substantially equal distances to either side of the first mentioned aperture, said pair of apertures being equally spaced from the bag pad back panel flange edgings.

4. The improvement set forth in claim 1 wherein:

said bag diagonal edges are rectilinear for their full lengths and intersect the respective bag side end seals at approximately one third of the height of the respective bags in their flattened relation.

5. The improvement set forth in claim 1 wherein:

said bag diagonal edges are rectilinear and are in tangent relation with curvilinear edgings that intersect the respective bag side end seals at approximately one third of the height of the respective bags in their flattened relation.

6. The improvement set forth in claim 1 wherein:

said bag back panel flanges at said edgings of same project depthwise of the respective bags a predetermined similar dimension for forming a common heat bonding area of the pad bags, and wherein the front and back panels of the respective bags are adhered together by a spot seal along the longitudinal centerline of the respective bags.

7. The improvement set forth in claim 6 wherein:

said spot seals are located adjacent but spaced from the respective bag bottom folds.

* * * * *